US005645512A

United States Patent [19]

Yu

[11] Patent Number: 5,645,512

[45] Date of Patent: Jul. 8, 1997

[54] STEP EXERCISING MACHINE

[76] Inventor: Hui-Nan Yu, P.O. Box 372, Hsin-chu, Taiwan

[21] Appl. No.: 687,940

[22] Filed: Jul. 29, 1996

[51] Int. Cl.[6] ..... A63B 22/04

[52] U.S. Cl. ..... 482/53; 482/147

[58] Field of Search ..... 482/51, 52, 53, 482/146, 147, 71

[56] References Cited

U.S. PATENT DOCUMENTS

| | | | |
|---|---|---|---|
| 2,906,532 | 2/1959 | Echols | 482/146 X |
| 4,629,181 | 12/1986 | Krive | 482/146 X |
| 5,230,675 | 7/1993 | Lin | 482/53 |
| 5,453,065 | 9/1995 | Lien et al. | 482/146 X |
| 5,527,253 | 6/1996 | Wilkinson | 482/147 |
| 5,545,111 | 8/1996 | Wang et al. | 482/53 |

*Primary Examiner*—Stephen R. Crow
*Assistant Examiner*—William LaMarca

[57] ABSTRACT

A step exercising machine including a base frame having an upright support, a T-shaped steering rod mounted in the upright support, a first steering gear mounted on the upright support around the vertical rod section of the T-shaped steering rod, two pedals respectively turned about the two opposite ends of the T-shaped steering rod, a second steering gear and a third steering gear respectively mounted around the two opposite ends of the transverse top of T-shaped steering rod and meshed with the first steering gear at two opposite sides, a locating rod transversely coupled to the T-shaped steering rod at the bottom, and two hydraulic cylinders respectively coupled between the pedals and the two opposite ends of the locating rod, wherein the second steering gear and the third steering gear are alternatively turned relative to the first steering gear when the pedals are alternatively stepped up and down, thereby causing the pedals to oscillate leftwards and rightwards alternatively.

3 Claims, 6 Drawing Sheets

STEP EXERCISING MACHINE

BACKGROUND OF THE INVENTION

The present invention relates to step exercising machines, and relates more particularly to such a step exercising machine which automatically forces the pedals to oscillate leftwards and rightwards alternatively when they are alternatively pedaled.

Conventional step exercising machines are commonly comprised of a base frame, two pedals pivotably coupled to the base frame for pedaling by the user, and a damping mechanism adapted for imparting a damping force to the pedals. These step exercising machines are designed for exercising the muscles of the legs only, therefore they produce little effect in exercising the muscles of the waist. If to exercise the muscles of the waist or the hips, a belt massager or the like may have to be used. However, it is not economic to prepare several exercising machines in order to exercise different parts of the body.

SUMMARY OF THE INVENTION

It is one object of the present invention to provide a step exercising machine which automatically forces the pedals to oscillate leftwards and rightwards alternatively when the pedals are stepped up and down alternatively. It is another object of the present invention to provide a step exercising machine which helps the user to twist the body without causing an athletic injury.

According to one embodiment of the present invention, the step exercising machine comprises a base frame having an upright support, a T-shaped steering rod mounted in the upright support, a first steering gear mounted on the upright support around the vertical rod section of the T-shaped steering rod, two pedals respectively turned about the two opposite ends of the T-shaped steering rod, a second steering gear and a third steering gear respectively mounted around the two opposite ends of the transverse top of T-shaped steering rod and meshed with the first steering gear at two opposite sides, a locating rod transversely coupled to the T-shaped steering rod at the bottom, and two hydraulic cylinders respectively coupled between the pedals and the two opposite ends of the locating rod, wherein the second steering gear and the third steering gear are alternatively turned relative to the first steering gear when the pedals are alternatively stepped up and down, thereby causing the pedals to oscillate leftwards and rightwards alternatively. As an alternate form of the present invention, a friction wheel and damping belt assembly may be used instead of the hydraulic cylinders to impart a damping force to the pedals.

DETAILED DESCRIPTION OF THE PREFERRED EMBODIMENTS

Figure 1:
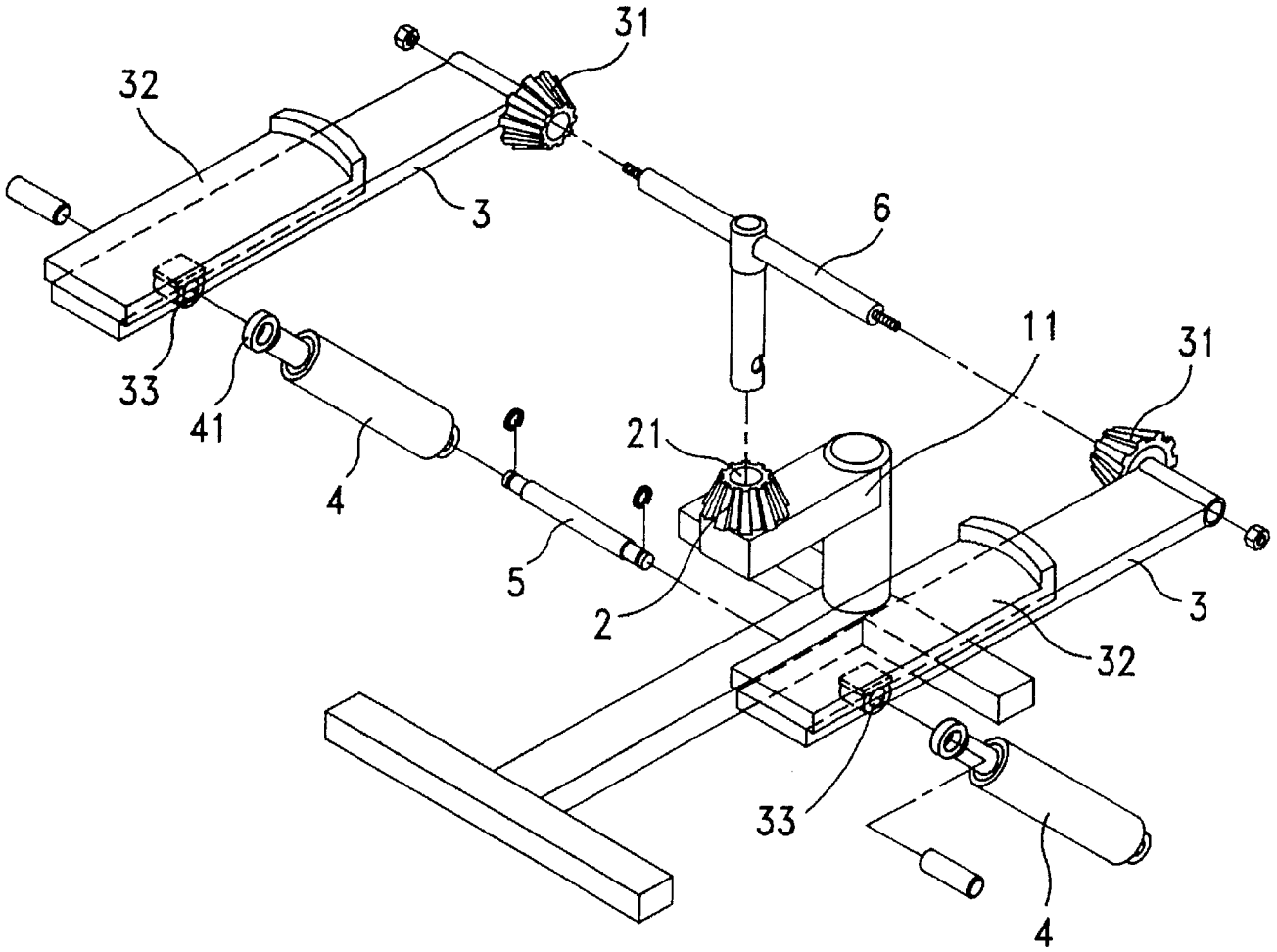
FIG. 1 is an exploded view of a step exercising machine according to one embodiment of the present invention (the handle stem excluded)
Figure 2:
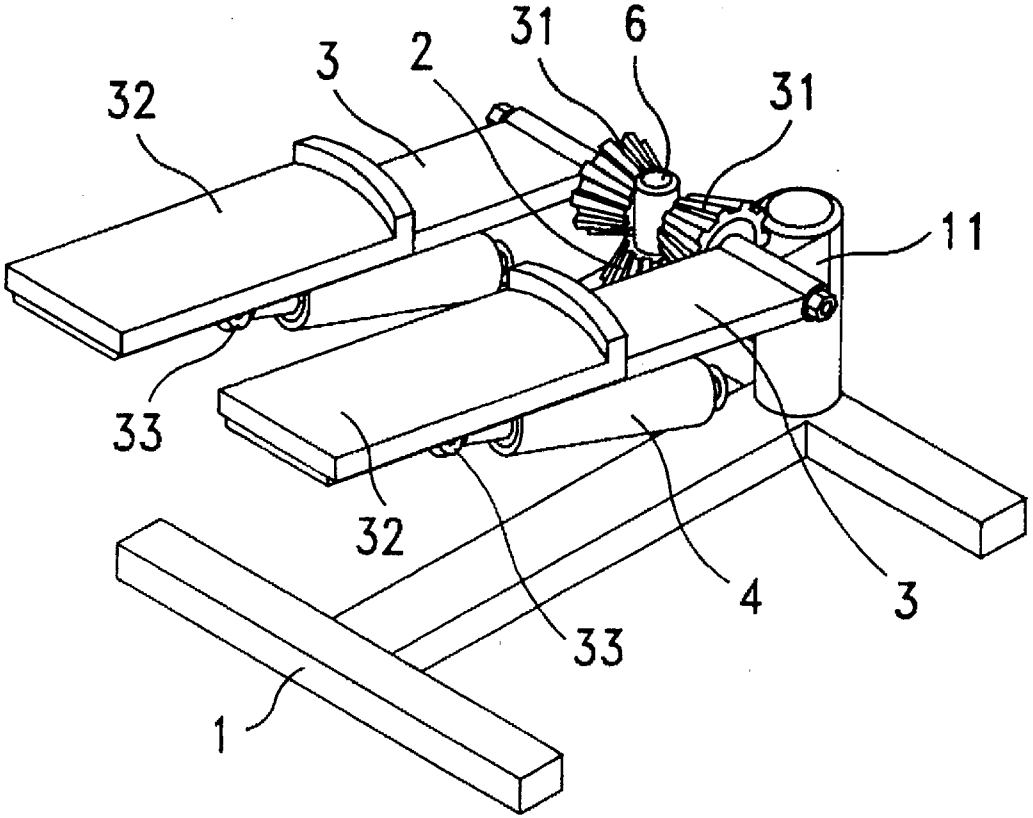
FIG. 2 is an assembly view of FIG. 1.
Figure 3:
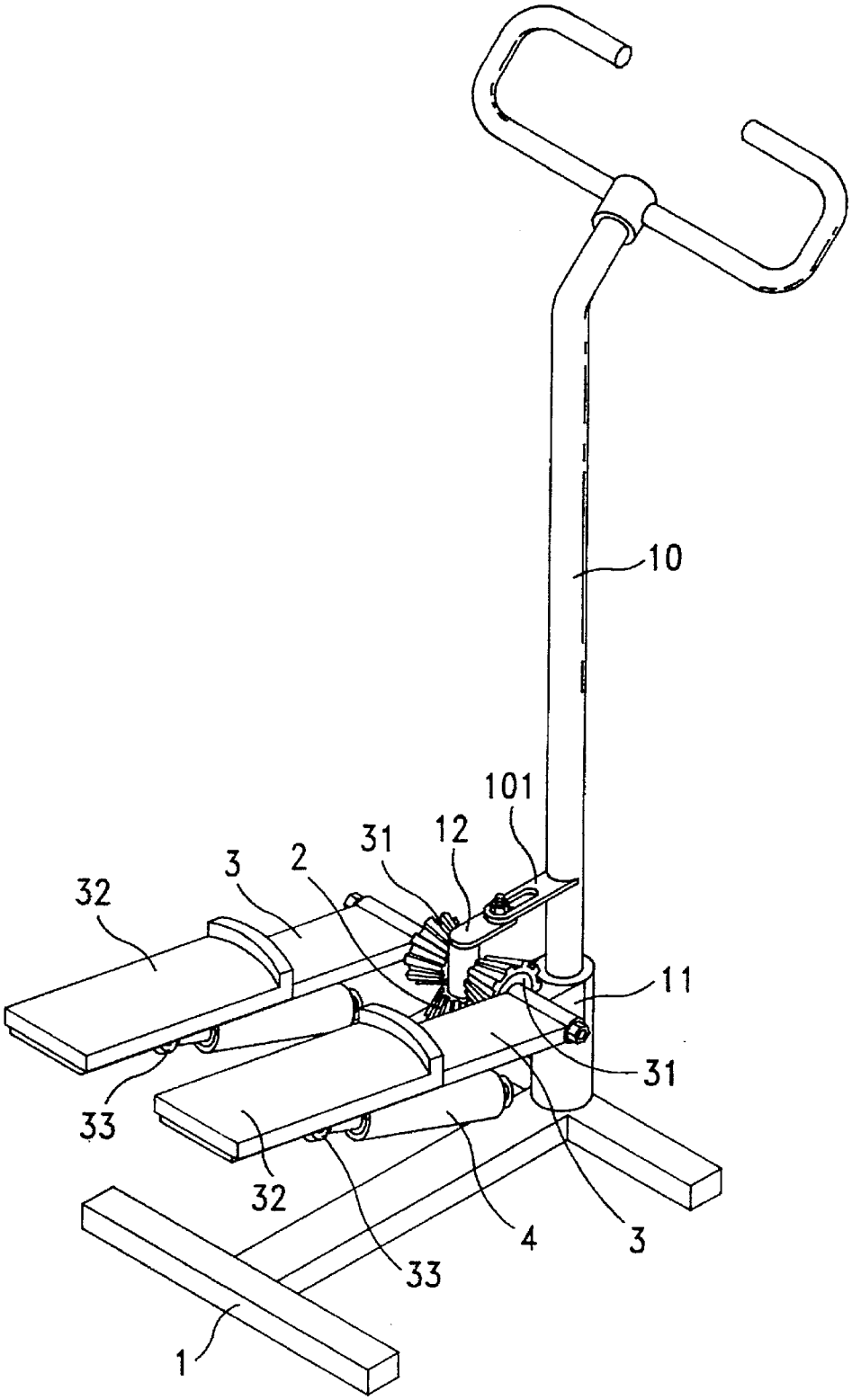
FIG. 3 is an elevational view of the step exercising machine of the first embodiment of the present invention.

Referring to FIGS. 1, 2, and 3, a step exercising machine in accordance with the present invention is generally comprised of a base frame 1, an upright support 11 raised from the front side of the base frame 1, a steering gear 2 mounted on the upright support 11 at the top, a T-shaped steering rod 6 mounted in the center hole 21 of the steering gear 2, a locating rod 5 coupled to the bottom end Of the T-shaped steering rod 6, two pedals 3 respectively turned about the two opposite ends of the transverse top of the T-shaped steering rod 6 and having a respective foot hold 32 at the free end and a respective coupling 33 at the bottom side of the respective foot hold 32, two hydraulic cylinders 4 bilaterally connected between the pedals 3 and the locating rod 5, each hydraulic cylinder 4 having a rear end terminating in a lug 41 coupled to the coupling 33 of one pedal 3 and a front end coupled to one end of the locating rod 5, two steering gears 31 respectively mounted around the two opposite ends of the transverse top of the steering rod 6 between the pedals 3 and meshed with the steering gear 2 at two opposite sides, a handle stem 10 mounted in the upright support 11 in front of the steering rod 6 and having a lug 101 near the bottom, and a connecting plate 12 connected between the lug 101 of the handle stem 10 and the center of the transverse top of the steering rod 6.

Figure 4:
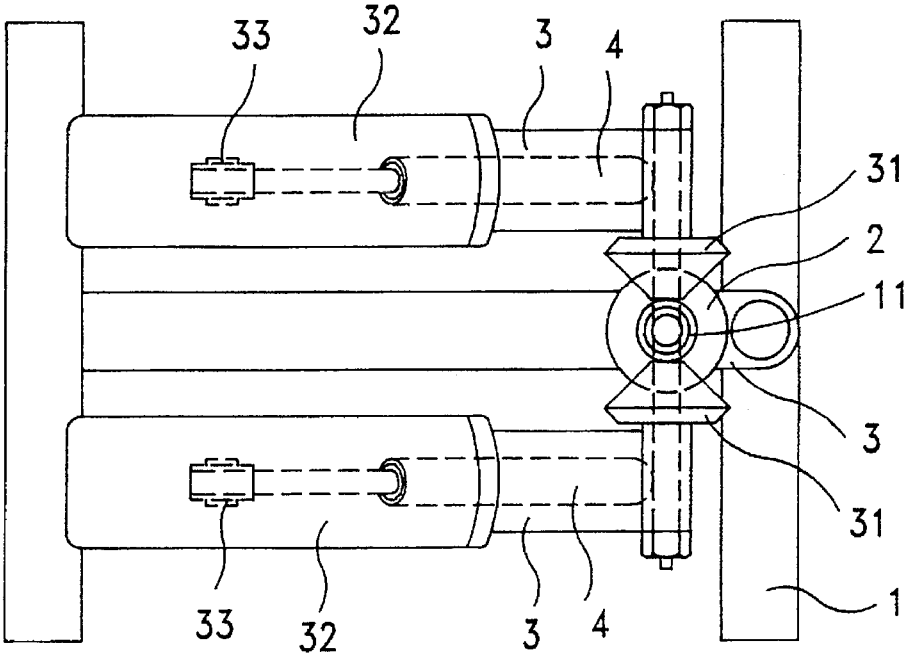
FIG. 4 is a top plain view of FIG. 2.
Figure 5:
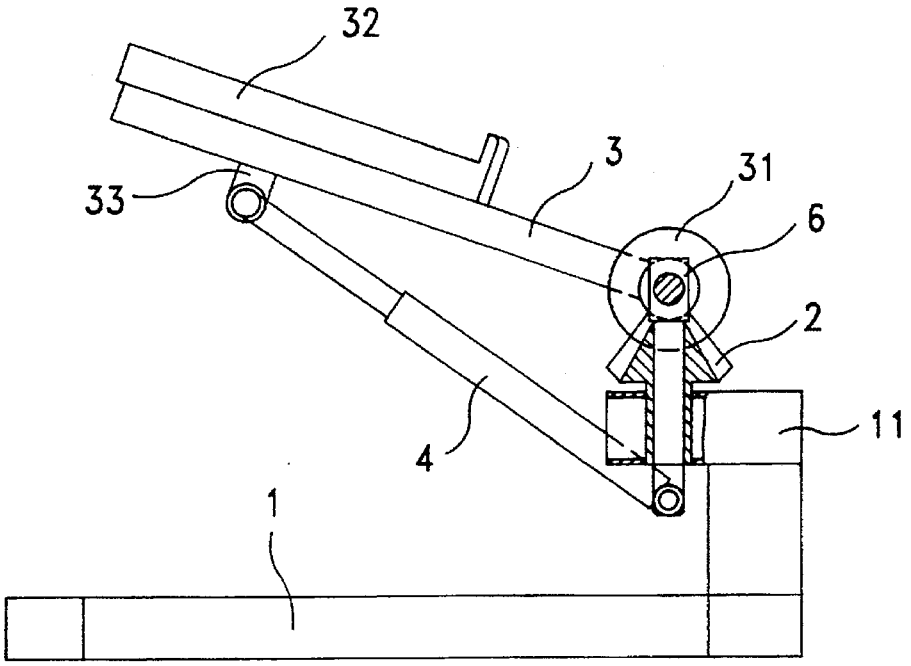
FIG. 5 is a side plain view of FIG. 2.
Figure 6:
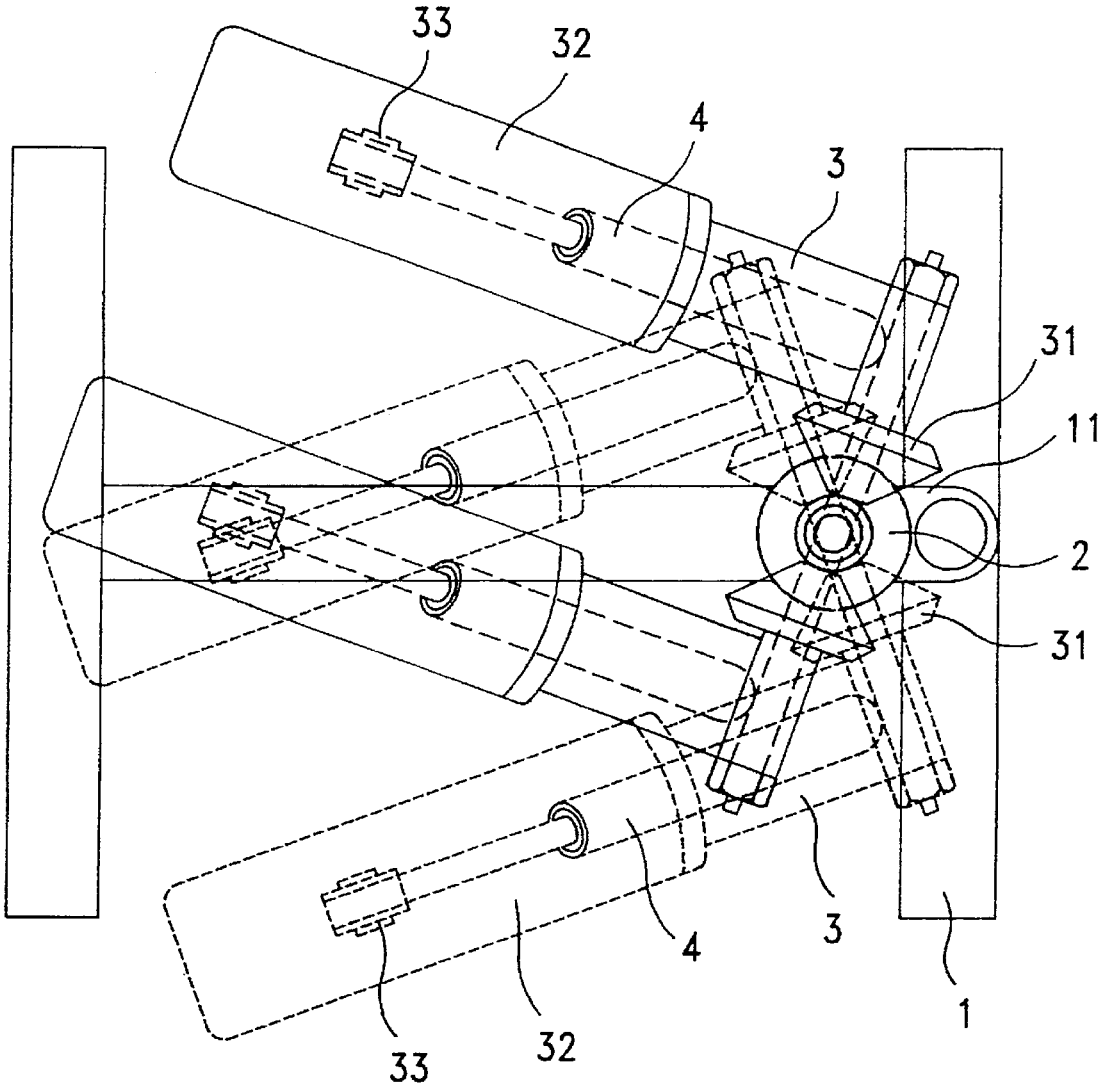
FIG. 6 is an applied view of the first embodiment of the present invention, showing the pedals stepped up and down and oscillated leftwards and rightwards alternatively.

Referring to FIGS. 4, 5, and 6, when the pedals 3 are alternatively pedaled, the hydraulic cylinders 4 are reciprocated to impart a damping force to the player, and at the same time the steering gears 31 are alternatively turned relative to the steering gear 2, thereby causing the steering rod 6 to oscillate leftwards and rightwards alternatively.

Figure 7:
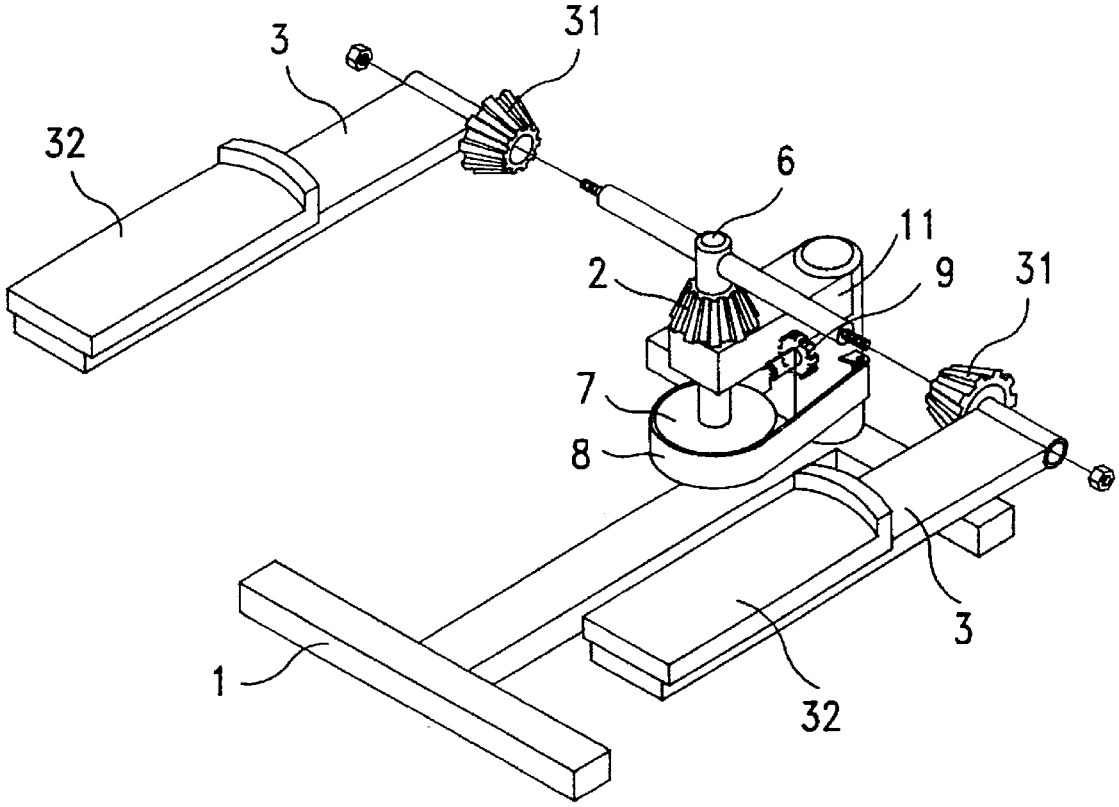
FIG. 7 is an exploded perspective view of a step exercising machine according to a second embodiment of the present invention.

FIG. 7 shows an alternate form of the present invention, in which a friction wheel 7 is fixedly mounted around the bottom end of the T-shaped steering rod 6, a damping belt 8 is mounted around the friction wheel 7 and having two opposite ends fixedly connected to the upright support 11 at two opposite sides, and a hand wheel 9 is installed in the upright support 11 and adapted for adjusting the tension of the damping belt 8. This alternate form eliminates the installation of the aforesaid hydraulic cylinders 4.

It is to be understood that the drawings are designed for purposes of illustration only, and are not intended as a definition of the limits and scope of the invention disclosed.

What the invention claimed is:

1. A step exercising machine comprising:

a base frame having an upright support;

a T-shaped steering rod having a horizontal rod section and a vertical rod section perpendicularly and downwardly extending from said horizontal rod section and mounted in a hole in said upright support;

a first steering gear mounted around the vertical rod section of said T-shaped steering rod above said upright support;

two pedals having a respective fixed end turned about one end of the horizontal rod section of said T-shaped steering rod, and a respective free end for pedaling by the user;

a second steering gear and a third steering gear respectively mounted around the two opposite ends of the transverse top of said steering rod between said pedals and meshed with said first steering gear at two opposite sides;

a handle stem mounted in said upright support in front of said steering rod and having a lug near a bottom end thereof;

a connecting plate connected between the lug of said handle stem and the transverse top of said steering rod; and a damping mechanism adapted for imparting a damping force to said pedals when said pedals are pedaled;

wherein said second steering gear and said third steering gear are alternatively turned relative to said first steering gear when said pedals are alternatively stepped up and down by the user, thereby causing said pedals to oscillate leftwards and rightwards alternatively.

2. The step exercising machine of claim 1 wherein said damping mechanism comprises a horizontal locating rod coupled to the vertical rod section of said T-shaped steering rod, and two hydraulic cylinders respectively coupled between two opposite ends of said horizontal locating rod and the free ends of said pedals.

3. The step exercising machine of claim 1 wherein said damping mechanism comprises a friction wheel fixedly mounted around the vertical rod section of said T-shaped steering rod, a damping belt mounted around said friction wheel and having two opposite ends fixedly connected to said upright support at two opposite sides, and a hand wheel installed in said upright support adapted for adjusting the tension of said damping belt.

* * * * *